United States Patent [19]

Liverance et al.

[11] Patent Number: 4,882,660

[45] **Date of Patent: * Nov. 21, 1989**

[54] HEADLAMP ASSEMBLY

[75] Inventors: Martin K. Liverance, Royal Oak, Mich.; David R. McMahan; Bartly A. Haydu, both of Anderson, Ind.

[73] Assignee: General Motors Corporation, Detroit, Mich.

[ * ] Notice: The portion of the term of this patent subsequent to May 24, 2005 has been disclaimed.

[21] Appl. No.: 276,608

[22] Filed: Nov. 28, 1988

Related U.S. Application Data

[63] Continuation of Ser. No. 185,209, Apr. 18, 1988, abandoned, which is a continuation of Ser. No. 930,741, Nov. 13, 1986, Pat. No. 4,747,029.

[51] Int. Cl.[4] ..... H01R 33/00

[52] U.S. Cl. ..... 362/226; 362/61; 313/113; 439/546; 439/616

[58] Field of Search ..... 362/266, 257, 296, 306, 362/341, 226, 457, 429, 310, 61; 439/546, 616; 313/113, 114, 115

[56] References Cited

U.S. PATENT DOCUMENTS

| | | | |
|---|---|---|---|
| 2,117,757 | 5/1938 | Douglas . | |
| 2,117,760 | 5/1938 | Douglas | 362/226 |
| 2,117,761 | 5/1938 | Douglas . | |
| 2,219,770 | 10/1940 | Falge et al. | 362/226 |
| 2,233,486 | 4/1941 | Portnow | 362/226 |
| 3,008,039 | 11/1961 | Baldwin | 362/226 |
| 3,553,519 | 1/1971 | Hicks | 313/113 |
| 3,593,017 | 7/1971 | Cibie . | |
| 3,621,232 | 11/1971 | Hough et al. | 362/226 |
| 3,749,960 | 7/1973 | Fuqua et al. | 313/318 |
| 3,818,215 | 6/1974 | Schmidt et al. | 362/226 |
| 3,904,904 | 9/1975 | Meincke et al. | 313/113 |
| 4,019,045 | 4/1977 | Bassett | 362/226 |
| 4,029,953 | 6/1977 | Natoli | 362/226 |
| 4,029,985 | 6/1977 | Rachel | 362/61 |
| 4,268,895 | 5/1981 | Yabata | 362/307 |
| 4,271,459 | 6/1981 | James | 362/346 |
| 4,384,319 | 5/1983 | Blaisdell et al. | 362/296 |
| 4,427,255 | 1/1984 | Cox | 339/127 C |
| 4,450,511 | 5/1984 | Micha | 362/267 |
| 4,513,356 | 4/1985 | Mikola | 362/226 |
| 4,578,742 | 3/1986 | Klein et al. | 362/294 |
| 4,682,274 | 7/1987 | Freudenreich et al. | 362/61 |
| 4,747,029 | 5/1988 | Liverance et al. | 362/226 |
| 4,760,506 | 7/1988 | Mochizuki et al. | 362/226 |
| 4,794,500 | 12/1988 | Bradley | 362/61 X |

FOREIGN PATENT DOCUMENTS

| | | |
|---|---|---|
| 1120106 | 7/1068 | United Kingdom . |

*Primary Examiner*—Stephen F. Husar
*Assistant Examiner*—Peggy Neil
*Attorney, Agent, or Firm*—Edward J. Biskup

[57] ABSTRACT

A vehicle headlamp in which the rear of the reflector has fastened thereto a retainer assembly that receives a replaceable light bulb and includes a shield for blocking stray light rays emanating from the light bulb.

12 Claims, 3 Drawing Sheets

HEADLAMP ASSEMBLY

This is a continuation of application Ser. No. 97/185,209 filed on Apr. 18, 1988 now abandoned which was a continuation of application Ser. No. 930,741 filed on Nov. 13, 1986 (now U.S. Pat. No. 4,747,029).

This invention concerns headlamps and more particularly relates to a vehicle headlamp having a retainer arrangement for maintaining a replaceable light bulb within an opening formed in the rear of a headlamp reflector.

More specifically, the vehicle headlamp according to the present invention includes a reflector, the rear portion of which has a circular opening. A retainer assembly is secured to the rear portion of the reflector for supporting a replaceable light bulb and serves to locate the light bulb in a predetermined position relative to the reflecting surface of the reflector. In the preferred form, the retainer assembly includes an inner disk member and an outer disk member fastened together so as to form a cavity for receiving the light bulb. The outer disk member is formed with a plurality of access slots and spring members for receiving the retainer members formed on the light bulb after which the latter is rotated so that the retainer members move into the cavity and assume a locked position relative to the retainer assembly. The inner disk member has a central opening surrounded by an axially extending skirt which supports a shield for blocking stray light rays emanating from the light bulb when the replaceable light bulb is located within the reflector.

The objects of the present invention are to provide a new and improved vehicle headlamp provided with a retainer assembly for a replaceable light bulb that is fastened to the rear of the reflector and is formed by a pair of disk members one of which has access slots for receiving the retainer members on the light bulb; to provide a new and improved vehicle headlamp in which the reflector carries a heat sink in the form of a retainer assembly that receives a replaceable light bulb and includes a shield attachable thereto for blocking stray light rays emanating from the light bulb; to provide a new and improved vehicle headlamp having a retainer assembly fastened to the rear of the reflector that includes a pair of disk members fastened together so as to provide a circular cavity for accommodating the retainer members formed on a replaceable light bulb and has locator tabs formed on the retainer assembly cooperating with bosses and locator pads on the reflector for properly locating the retainer assembly on the reflector; and to provide a new and improved vehicle headlamp which includes a retainer assembly that receives and supports a replaceable light bulb in a predetermined position relative to the reflecting surface of the reflector and also has connected thereto a cylindrical shield for blocking stray light rays emanating from the light bulb.

Other objects and advantages of the present invention will be apparent from the following detailed description when taken with the drawings in which FIG. 1 is a plan view showing a vehicle headlamp partially in section with the lens removed and made in accordance with the present invention;

Figure 1:
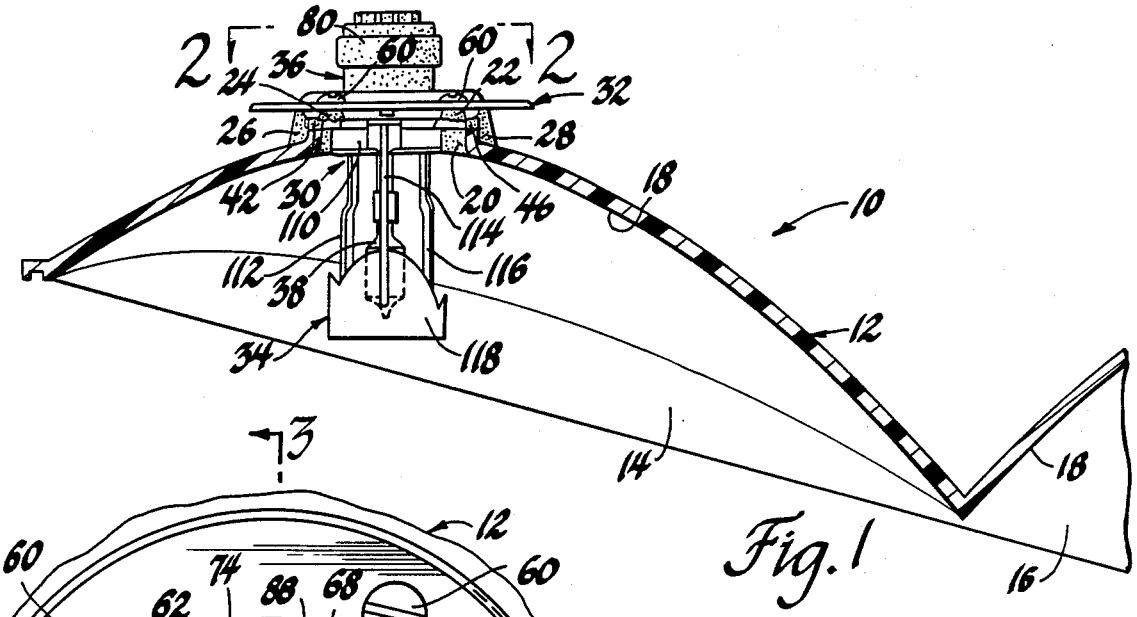
Figure 6:
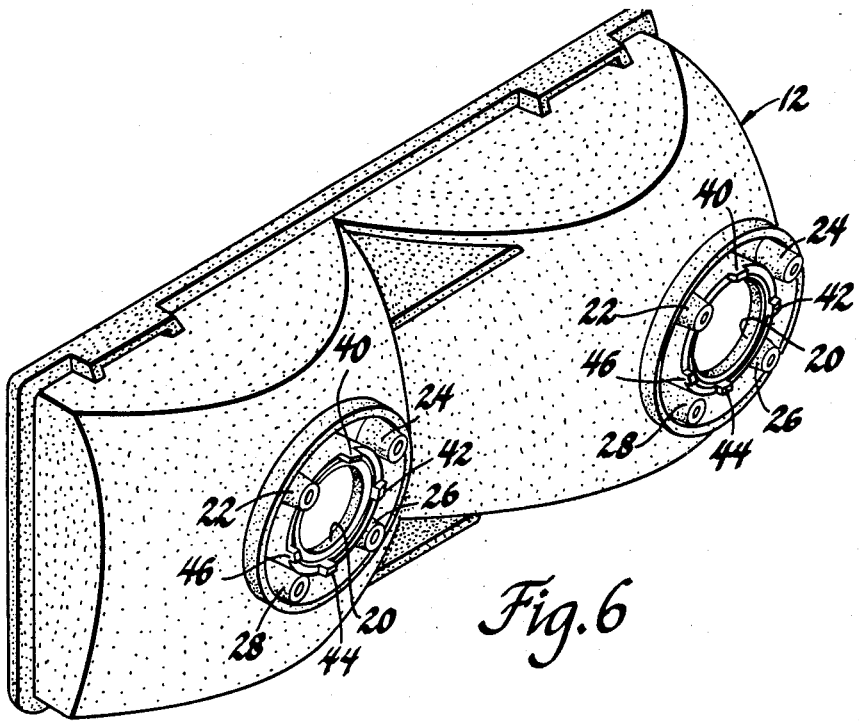
FIG. 6 is a perspective view showing the construction of the rear portion of the reflector shown in FIG. 1 with the retainer assembly removed therefrom.

Referring now to the drawings and more particularly FIG. 1 thereof, a vehicle headlamp 10 (with lens removed) made in accordance with the present invention is shown having a reflector 12 made of plastic and formed with a pair of side-by-side cavities 14 and 16 each of which has an aluminized parabolic reflecting surface 18. As seen in FIGS. 1 and 6, the rear of each cavity 14 and 16 of the reflector 12 is formed with a circular opening 20 surrounded by four circumferentially spaced and identical cylindrical bosses 22, 24, 26, and 28 to which is fastened a retainer assembly 30.

The retainer assembly 30 includes a retainer section 32 and a shield section 34, both of which are made from sheet metal. The retainer section 32 serves to support a replaceable light bulb assembly 36 and is fastened to the reflector 12 and located thereon so as to assure that the light bulb 38 is positioned in a predetermined position relative to the reflecting surface 18 of the associated cavity in the reflector 12. It will be noted that although both cavities of the reflector 12 may be provided with a retainer section identical to retainer section 32, the shield section 34 is only needed in the outboard cavity which accommodates a light bulb having filaments for both high beam and low beam projection. The shield section 34 serves to assure that when the low beam filament is energized, stray light rays are blocked and that a lighting pattern as prescribed by federal regulations is attained forwardly of the vehicle.

Figure 3:
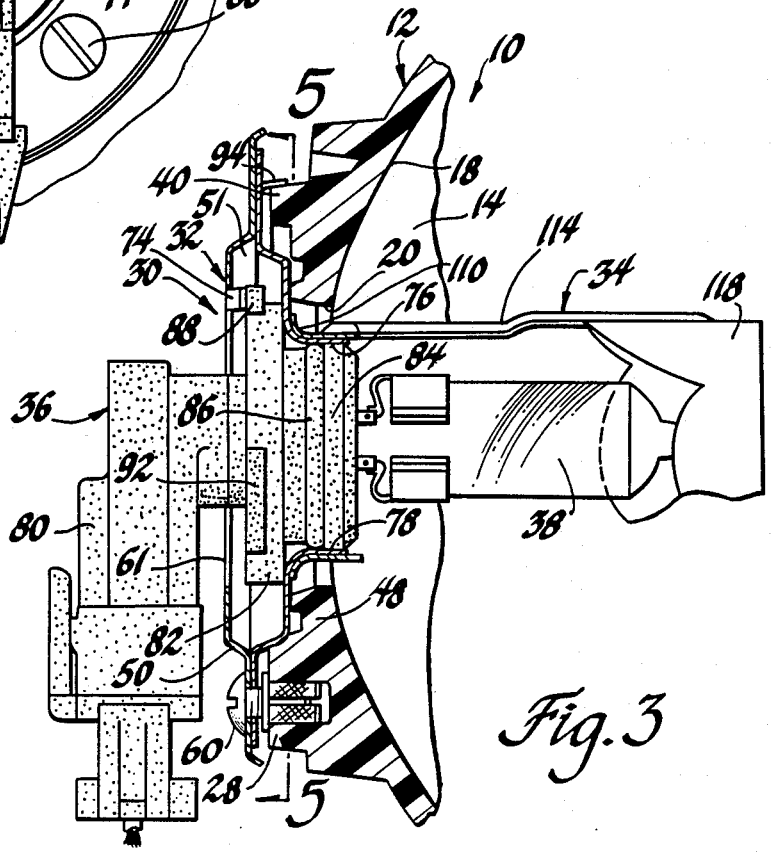
FIG. 3 is a side elevational view taken on line 3—3 of FIG. 2 showing the retainer assembly which includes a shield section for blocking stray light rays emanating from the light bulb.
Figure 5:
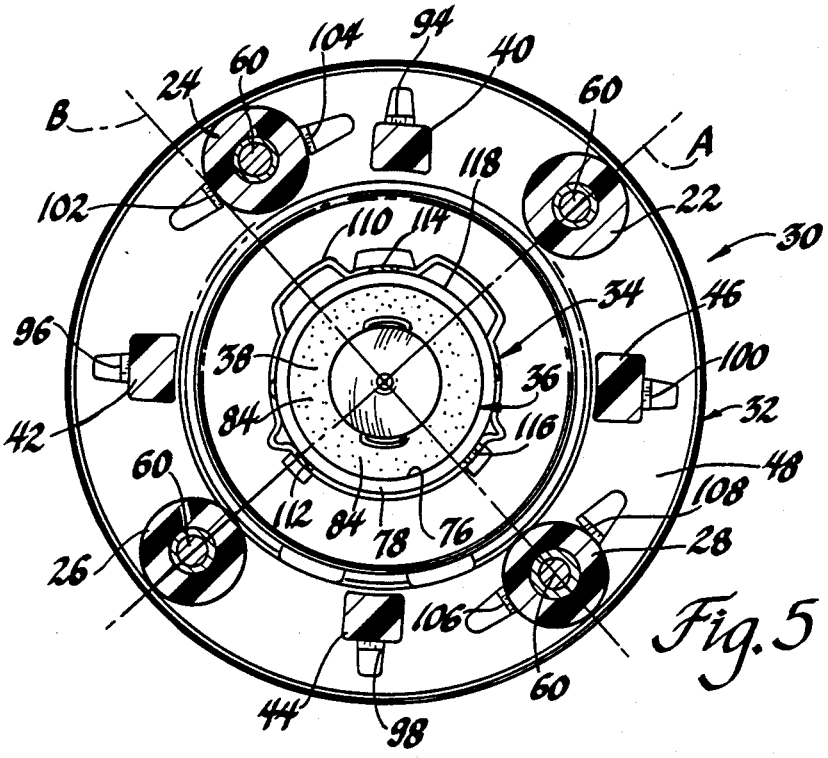
FIG. 5 is a view taken on a line 5—5 of FIG. 3 showing the construction of the inner disk member which forms a part of the retainer assembly.

As seen in FIGS. 3, 5, and 6, the circular opening 20 of each cavity 14 and 16 in the reflector 12 is also surrounded by four locator pads 40, 42, 44, and 46 which are integrally formed with the reflector 12. As will be hereinafter explained more fully, the outer peripheral surface of the locator pads 40, 42, 44, and 46 serve to properly locate the retainer section 32 along an X-axis and a Y-axis during the assembly of the retainer section 32 to the reflector 12.

Figure 2:
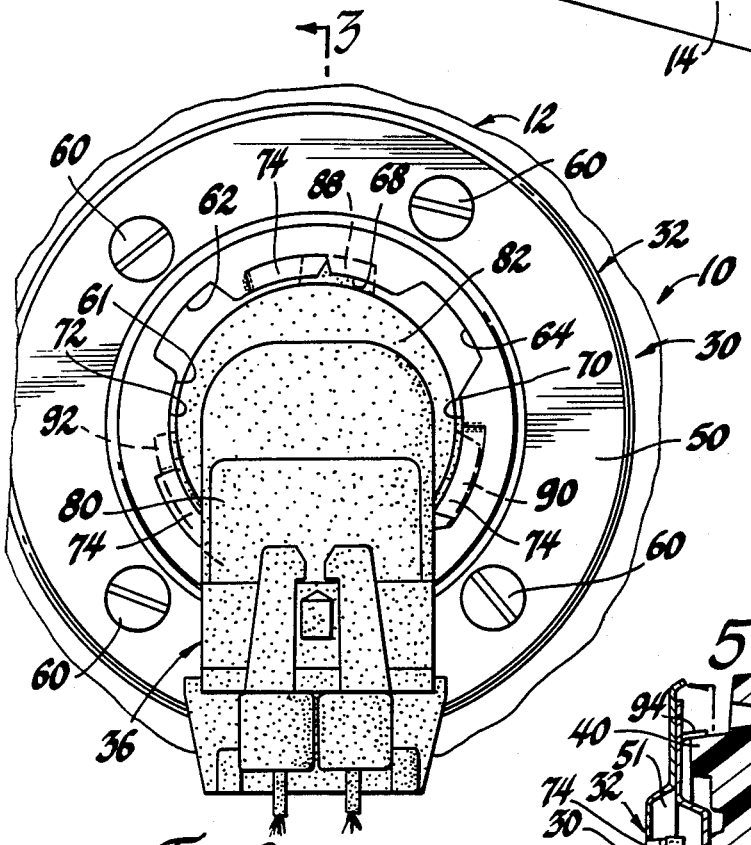
FIG. 2 is an enlarged elevational veiw taken on line 2—2 of FIG. 1 showing the rear of a retainer assembly for a replaceable light bulb that forms a part of the vehicle headlamp.
Figure 4:
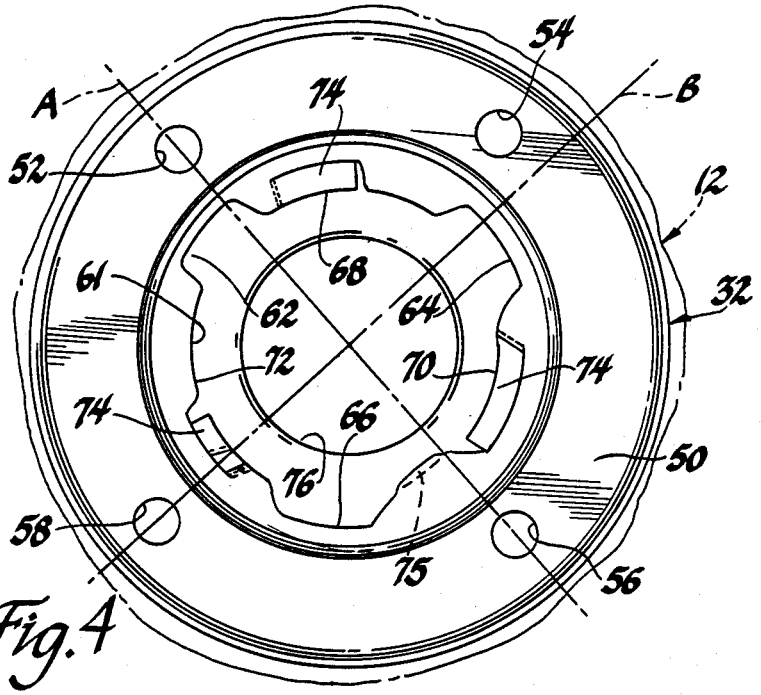
FIG. 4 is a view of the retainer assembly similar to the view in FIG. 2 with the replaceable light bulb removed.
Figure 7:
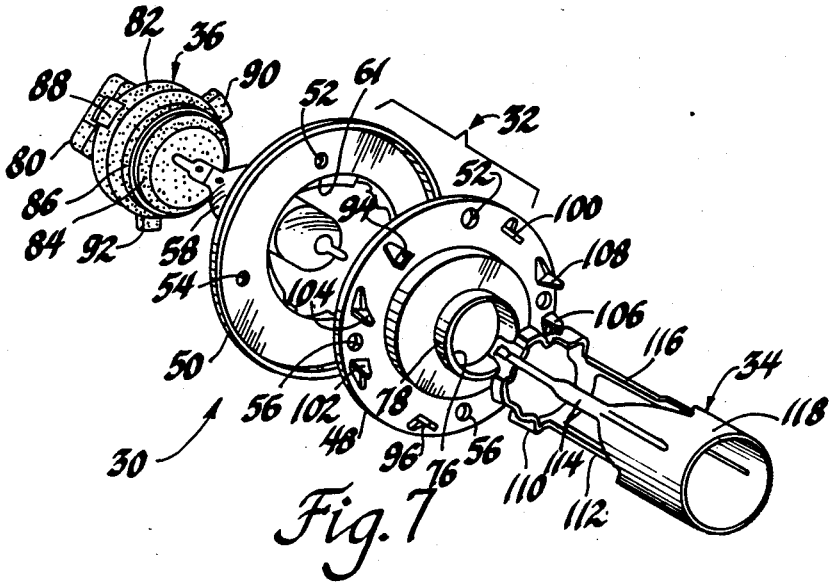
FIG. 7 is an exploded view showing the various parts of the retainer section and the attachable shield section which make up the retainer assembly.

Referring now to FIGS. 2, 3, and 7, the retainer section 32 includes an inner disk member 48 and an outer disk member 50, each of which is generally hat-shaped in cross-section. The disk members 48 and 50 are fastened together by spot welding or the like so as to form a unitary member having a ring-like cavity 51 for supporting the light bulb assembly 36. More specifically, the outer disk member 50 as well as the inner disk member 48, as seen in FIG. 4, have four identical circular registering openings 52, 54, 56 and 58 formed therein through which fastener means such as screws 60 (seen in FIGS. 2 and 3) serve to secure the retainer section 32 to the cylindrical bosses 22–28 formed on the reflector 12. In this regard, it will be noted that as seen in FIG. 5, the center of the bosses 22 and 26 are aligned along an axis A passing through the center of the retainer member 32. On the other hand, the center of the boss 24 is offset angularly relative to the axis B which passes through the center of the retainer section 32 and through the center of the boss 28. As should be apparent, the openings 52–58 formed in the retainer section 32 are similarly arranged so as to assure proper location of the retainer section 32 onto the reflector 12 during the assembly operation.

As seen in FIG. 4, the outer disk member 50 is formed with a central opening 61 surrounded by three radially extending access slots 62, 64 and 66 which connect with curved walls 68, 70 and 72, each of which includes a spring section 74 depressed towards the inner disk member 48. In addition, an inwardly projecting stop member 75 is formed on the wall 70. The inner disk member 48 is formed with a circular opening 76 which, as seen in FIG. 3, is defined by an axially extending cylindrical skirt portion 78.

The central opening 61 in the outer disk member 50 is adapted to receive the light bulb assembly 36 and, in this regard, it will be noted that as seen in FIGS. 1, 2, and 3, the light bulb assembly 36 includes a body portion 80 made of an insulating material such as plastic that receives the wedge-base type light bulb 38. The body portion 80 is integrally formed with a collar 82 having an outer diameter larger than the diameter of the opening 76 formed in the inner disk member 48 and smaller than the opening 61 defined by the curve walls 68–72 of the outer disk member 50. A neck portion 84 is integrally formed with the collar 82 and carries an O-ring 86 which assures a snug sealed fit is realized between the inner wall of the opening 76 and the neck portion 84 when the light bulb assembly 36 is located in the retainer section 32 as seen in FIG. 3. It will also be noted that the collar 82 is integrally formed with three radially outwardly extending and circumferentially spaced retainer members 88, 90 and 92 which are adapted to be received by the access slots 62, 64 and 66, respectively, formed in the outer disk member 50 of the retainer section 32. In this regard, it will be noted that the access slots 64 and 66 are identical in size and configuration while the access slot 62 is smaller in size than the slots 64 and 66. Similarly, the retainer and members 90 and 92 have the general configuration and size of access slots 64 and 66 while retainer member 88 is designed to be received only by access slot 62. This retainer member and access slot design assures that the light bulb assembly 36 is properly located within the opening 61 in the retainer section 32 when manually inserted therein.

Thus, when the light bulb assembly 38 is inserted into the opening 61, the retainer members 88, 90 and 92 are aligned with and located within the access slots 62, 64, and 66 and afterwards the body portion 80 is rotated clockwise until retainer member 90 contacts the stop 75. As seen in FIG. 2, the light bulb assembly 38 will then assume the position shown in FIGS. 2 and 3 at which point the light bulb assembly 36 is prevented from further clockwise movement by the stop member 75 seen in FIG. 4. It will be understood that the spring sections or arms 74 adjacent each access slot serve to press the collar 82 into contact with the inner disk member as seen in FIG. 3 so that proper orientation of the light bulb assembly 36 along the longitudinal axis of the bulb 38 and relative to the reflecting surface 18 is attained.

Referring again to the inner disk member 48 and particularly FIGS. 3 and 5, it will be noted that the rim portion of the inner disk member 48 has four locator tabs 94, 96, 98 and 100 projecting outwardly therefrom and located on a circle concentric with the opening 76. The locator tabs 94, 96, 98 and 100 cooperate with the locator pads 40, 42, 44 and 46, respectively, for properly locating the retaining section 32 along the aforementioned X-axis and Y-axis. Also, two sets of locator tabs 102, 104 and 106, 108 are provided which cooperate with the bosses 24 and 28 formed on the reflector 12 for properly locating the retainer assembly 30 angularly relative to the opening 20 in the reflector 12. Inasmuch as the boss 24 is offset as explained hereinbefore, it should be apparent that the retainer section 32 cannot be located on the reflector 12 except in one position relative to the opening 20, that position being as seen in FIGS. 2 and 3.

As seen in FIGS. 1, 3, and 7, the shield section 34 is formed with a ring like mounting member 110 which mounts onto the skirt 78 and is connected by three axially extending arms 112, 114, and 116 to the shield portion 118. The shield portion 118 serves in the usual manner, namely to prevent light rays emanating directly from the low beam filament of the light bulb 38 to pass out of the reflector without being reflected by the parabolic reflecting surface 18. As heretofore alluded to, this assures that the proper pattern of light is projected forwardly of the vehicle when the low beam filament is energized.

Thus, from the above description, it should be apparent that when the retainer section 32 is fastened to the reflector 12, the locator pads 40–46 and the bosses 24 and 28 cooperate with the locator tabs 94–108 on the inner disk member 48 to assure that the skirt portion 78 is properly located in the opening 20 of the reflector 12. In addition, depending upon the size of the opening 20 of the reflector 12, the shield section 34 can be either preassembled onto the skirt portion 78 as shown in FIG. 3, and passed through the opening 20 or mounted on the skirt portion 78 after the retainer section 32 is fastened to the reflector 12 and before the lens is sealed to the reflector. In either case, inasmuch as the shield member 34 connects to the retainer member 32 directly, one is assured that the shield member 34 is properly located at all times relative to the light bulb 38. Also, because the retainer section 32 and shield section 34 are both made from a metallic material, they both serve as a heat sink for helping dissipate heat generated by the light bulb assembly 36.

Various changes in modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In combination, a vehicle headlamp assembly including a reflector formed with a pair of side-by-side cavities each of which has a parabolic reflecting surface and a circular opening formed in each of said reflecting surfaces and adapted to receive the light bulb of a replaceable light bulb assembly from the rear of said reflector, a retainer located at the rear of said reflector and forming a permanent part thereof for positioning said light bulb assembly in a predetermined position relative to said opening, and a replaceable light bulb assembly having a lamp bulb smaller in diameter than said opening and having a collar formed with three circumferentially spaced retainer members projecting radially outwardly therefrom, said retainer having three access slots formed therein for selectively receiving said three retainer members of said replaceable bulb assembly, said retainer including an inner member and an outer member defining a ring-like cavity with an axial dimension sufficient to accommodate said retainer members on said light bulb assembly, one of said inner and outer members having a stop, said access slots upon receiving said retainer members of said light bulb assembly permitting said collar and said retainer members to move into said ring-like cavity from the rear thereof after which said light bulb assembly is rotatable into engagement with said stop to orient said light bulb assembly rotationally with respect to said reflector, and spring means in said ring-like cavity continuously engaging and pressing said retainer members inwardly towards said opening when said light bulb assembly is rotated to orient said light bulb axially with respect to said reflector.

2. The combination of claim 1 wherein said vehicle headlamp assembly has a vertical height and axial depth dimension less than its overall width dimension, said light bulb assembly has a body portion for said light bulb located within said depth dimension when said retainer members are pressed inwardly towards said opening, and said body portion having an angled part orientated rotationally with respect to said light bulb and connectable to a power supply along a non-axial axis when said stop is engaged.

3. In combination, a vehicle headlamp assembly including a reflector formed with a pair of side-by-side cavities each of which has a parabolic reflecting surface, a circular opening formed in each of said reflecting surfaces and adapted to receive the light bulb of a replaceable light bulb assembly provided with three circumferentially spaced retainer members projecting outwardly from a collar formed as a part of said replaceable light bulb assembly, a retainer located at the rear of said reflector and forming a permanent part thereof for positioning said light bulb assembly in a predetermined position relative to said opening, three access slots formed in said retainer for receiving said three retainer members of said replaceable bulb assembly, said retainer including an inner member and an outer member providing a ring-like cavity substantially the same in axial dimension as said collar for accommodating said collar and said retainer members on said light bulb assembly, one of said members having a stop, said access slots adapted to receive said retainer members of said light bulb assembly and permitting said collar and said retainer members to move into said ring-like cavity after which said light bulb assembly is rotatable into engagement with said stop to orient said light bulb assembly rotationally with respect to said reflector, and spring means carried by said retainer adjacent each of said slots encircling said collar for continuously engaging and pressing said retainer members toward said opening when said light bulb assembly is rotated to orient said light bulb assembly axially with respect to said reflector.

4. The combination as set forth in claim 1 wherein said spring means are offset circumferentially from each of said slots.

5. The combination as set forth in claim 3 wherein said outer member is formed with said three access slots and said spring means, and said spring means are located on a circle having a diameter larger than the outer diameter of said collar.

6. In combination, a vehicle headlamp assembly including a reflector formed by a pair of side-by-side cavities having a circular opening at the rear of each cavity of said reflector for receiving a respective replaceable light bulb assembly having a circular body portion insertable axially into said circular opening and integrally formed with three radially outwardly extending retainer members one of which is differently sized, said body portion having a part which is angled with respect to a longitudinal axis of the light bulb of said light bulb assembly and connectable to a power supply, locator means formed on said reflector along a common predetermined circle and a plurality of circumferentially spaced bosses surrounding said opening for assuring proper axial positioning of said light bulb in said circular opening along said longitudinal axis, a retainer for accommodating said light bulb assembly, said retainer comprising one portion supported on said bosses and another portion forming a circular cavity adjacent said circular opening for retaining said retainer members of said light bulb assembly, said another portion of said retainer formed with three circumferentially spaced access slots for receiving said retainer members into said circular cavity in one manner predetermined by the differently sized retainer member and formed with a press section to press said body portion toward said circular opening for proper orientation of said light bulb with respect to its respective reflector cavity along its longitudinal axis, said one portion of said retainer cooperating with said bosses and said locator means for angularly positioning said retainer on the rear of its respective reflector cavity, and means securing said retainer to said bosses.

7. The combination of claim 6 wherein said pair of reflector cavities are adapted for receiving light bulbs having filament means for both high beam and low beam projection by the cooperation of said one portion of said retainer with said bosses and locator means, said locator means locating said retainer with respect to the center of said circular opening at the rear of the associated cavity and said bosses rotationally locating said retainer members with respect to said circular opening axis thereby to assure that when the filament means is connected to said power supply a predetermined lighting pattern is attained.

8. The combination of claim 6 wherein said side-by-side reflector cavities are inboard and outboard cavities, and said light bulb cooperates with means only accommodated by the said outboard reflector cavity.

9. The combination of claim 8 wherein said means is a shield secured to said retainer in said outboard cavity and is insertable depending on the size of the circular opening of the reflector.

10. A vehicle headlamp assembly comprising a reflector formed by a pair of side-by-side cavities having a circular opening at the rear of each reflector cavity for receiving a respective replaceable light bulb assembly, a pair of replaceable light bulb assemblies each having a circular body portion supporting a light bulb insertable axially along a longitudinal axis of said light bulb into a respective one of said circular openings and rotatable with respect thereto, each light bulb assembly being integrally formed with radially outwardly extending retainer members, one of which is differently sized, locator means formed along a common predetermined circle surrounding each of said circular openings, and boss means formed on said reflector adjacent said locator means, a pair of retainers adapted for connection to said reflector for locating said pair of light bulbs in predetermined positions, each of said retainers comprising one portion supported on said boss means and another portion forming a circular cavity adjacent a respective one of said circular openings for retaining the retainer members of a respective one of said light bulb assemblies and for properly orientating a respective one of said light bulb assemblies in said circular opening along said longitudinal axis and an axis angled relative to said longitudinal axis, each of said another portion of each of said pair of retainers formed with circumferentially spaced access slots for receiving the retainer members of said respective light bulb assembly into said cavity in one manner predetermined by the differently sized retainer member and formed with a press section to press the body portion of said respective light bulb assembly toward its respective circular opening to assure proper orientation of said light bulb with respect to its respective cavity along its longitudinal axis, said body portion of each replaceable light bulb assembly having an angled part adapted to be oriented rotationally with respect to its respective cavity for connection to a power supply, and each of said retainers when connected to said reflector cooperating with said boss means and said locator means for rotationally locating the retainer on the rear of its respective cavity to assure proper orientation of said angled part of a respective light bulb assembly with respect to an axis angled relative to said longitudinal axis of said light bulb when said light bulb assembly is inserted into its respective circular opening and rotated.

11. The vehicle headlamp assembly of claim 10 which has a vertical height and axial depth dimension less than its overall width dimension when the pair of light bulb assemblies are inserted into their respective circular openings and rotated.

12. In combination, a vehicle headlamp assembly including a reflector formed with a pair of side-by-side cavities each of which has a parabolic reflecting surface and a circular opening formed in each of said reflecting surfaces and adapted to receive the light bulb of a replaceable light bulb assembly from the rear of said reflector, locator means and boss means formed on said reflector and surrounding said opening for assuring proper positioning of said light bulb assembly in said opening along a longitudinal axis of the light bulb and an axis angled relative to said longitudinal axis, a retainer located at the rear of said reflector and having first portions thereof attached to said boss means and second portions thereof contacting said locator means for positioning said light bulb assembly in a predetermined position relative to said opening, and a replaceable light bulb assembly having a lamp bulb smaller in diameter than said circular opening and having a collar and three circumferentially spaced retainer members projecting radially outwardly therefrom, said retainer having three access slots formed therein for selectively receiving said three retainer members of said replaceable bulb assembly, said retainer defining a ring-like cavity with an axial dimension sufficient to accommodate said retainer members on said light bulb assembly and having a stop located in said cavity, said access slots upon receiving said retainer members of said light bulb assembly permitting said collar and said retainer members to move into said ring-like cavity from the rear thereof after which said light bulb assembly is rotatable into engagement with said stop to orient said light bulb asembly rotationally with respect to said reflector, and means formed as a part of said retainer extending into said ring-like cavity and continuously engaging and pressing said retainer members inwardly towards said opening when said light bulb assembly is rotated to orient said light bulb axially with respect to said reflector.

* * * * *